US008555749B2

(12) United States Patent
Gatski

(10) Patent No.: US 8,555,749 B2
(45) **Date of Patent: *Oct. 15, 2013**

(54) APPARATUS FOR REMOVING AND INSTALLING ELEVATED LIGHT BULBS

(76) Inventor: Frank P. Gatski, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/398,728

(22) Filed: Feb. 16, 2012

(65) Prior Publication Data

US 2013/0213186 A1 Aug. 22, 2013

(51) Int. Cl.
*H01K 3/32* (2006.01)

(52) U.S. Cl.
USPC ..... 81/53.11

(58) Field of Classification Search
USPC ..... 81/53.1–53.12
See application file for complete search history.

(56) References Cited

U.S. PATENT DOCUMENTS

| | | | | |
|---|---|---|---|---|
| 3,342,519 | A * | 9/1967 | Hunt et al. | 81/53.12 |
| 4,864,899 | A | 9/1989 | Morse | |
| 5,148,723 | A | 9/1992 | Newman, Sr. et al. | |
| 5,218,889 | A | 6/1993 | Brockberg | |
| 5,317,939 | A | 6/1994 | Marinescu | |
| 5,730,033 | A | 3/1998 | Mitrowski | |
| 6,223,628 | B1 | 5/2001 | Barron | |
| 6,257,095 | B1 | 7/2001 | Yukness | |
| 6,883,400 | B2 | 4/2005 | Sugano | |
| 6,928,901 | B1 * | 8/2005 | Rainin et al. | 81/53.1 |
| 7,131,352 | B1 * | 11/2006 | Saunders | 81/53.11 |
| 7,143,668 | B2 | 12/2006 | Johnson et al. | |
| 7,197,962 | B2 | 4/2007 | Williams | |
| 7,334,503 | B1 | 2/2008 | Newman | |
| 7,631,579 | B2 | 12/2009 | Johnson et al. | |
| 7,707,912 | B1 * | 5/2010 | Sparks | 81/3.4 |
| 7,856,907 | B2 * | 12/2010 | Johnson et al. | 81/53.12 |
| 8,104,380 | B2 | 1/2012 | Johnson et al. | |
| 2005/0083679 | A1 | 4/2005 | Macierowski | |
| 2010/0024606 | A1 * | 2/2010 | Becker | 81/53.11 |

FOREIGN PATENT DOCUMENTS

| | | | |
|---|---|---|---|
| JP | 11-053925 | A | 2/1999 |
| KR | 10-2001-0106647 | A | 12/2001 |
| KR | 20-0395605 | Y1 | 9/2005 |
| KR | 20-0427411 | Y1 | 9/2006 |
| KR | 10-2008-0103896 | A | 11/2008 |
| KR | 20-2010-0012507 | U | 12/2010 |

OTHER PUBLICATIONS http://www.instawares.com/floodsucker-light-bulb-changer.fs000unger.0.7.htm; Instawares.com; Sep. 18, 2012; 1 page.

http://www.thefind.com/homefurnishings/info-light-bulb-changer-pole#page=1&local=0; TheFind.com; Sep. 18, 2012; 3 pages.

* cited by examiner

*Primary Examiner* — Hadi Shakeri
(74) *Attorney, Agent, or Firm* — Greenberg Traurig

(57) ABSTRACT

An apparatus including an extendable (e.g., telescoping) pole with a handle at a first end and a light-bulb gripping unit at a second end. The gripping unit may include an adhesive member including a series of removal, disposable adhesive sheets having a "tacky" surface for controlling a light bulb during removal and installation. Different gripping units are configured for different light bulb types.

15 Claims, 3 Drawing Sheets

APPARATUS FOR REMOVING AND INSTALLING ELEVATED LIGHT BULBS

FIELD OF THE INVENTION

The embodiments of the present invention relate to an apparatus for changing light bulbs in elevated locations such as ceilings.

BACKGROUND

Exterior and indoor elevated lighting systems are very common and popular. One disadvantage of elevated lighting systems, whether exterior or interior, is the inconvenience and danger related to changing the associated light bulbs. For example, using a ladder to change elevated light bulbs is generally unsafe for people inexperienced at such tasks. The changing difficulties relate to any bulb type including incandescent, flood and compact fluorescent.

Thus, there exists a need for an apparatus configured to allow users to remove and install elevated light bulbs conveniently and safely.

SUMMARY

The embodiments of the present invention relate to an apparatus comprising broadly an extendable (e.g., telescoping) pole with a handle at a first end and a light-bulb gripping unit at a second end. In one embodiment, the light-bulb gripping unit comprises an adhesive member for controlling a light bulb. In one embodiment, the gripping unit includes an adhesive member having a series of removal, disposable adhesive sheets having a "tacky" surface for controlling a light bulb during removal and installation. Different gripping units are configured for different light bulb types.

Other variations, embodiments and features of the present invention will become evident from the following detailed description, drawings and claims.

DETAILED DESCRIPTION

Figure 1:
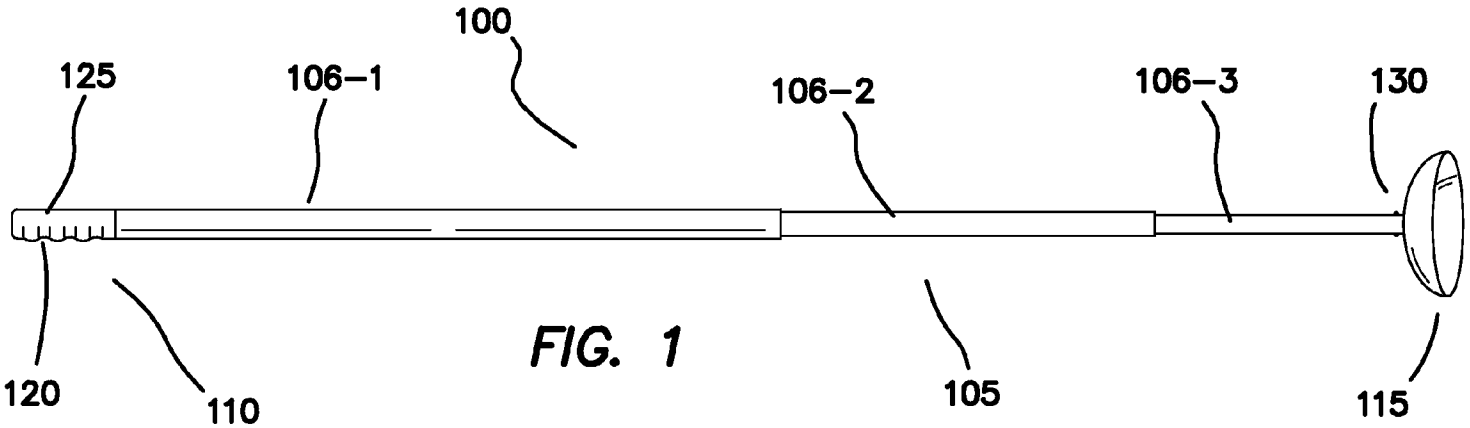
FIG. 1 illustrates a perspective view of an apparatus for removing and installing elevated light-bulbs according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

FIG. 1 shows an apparatus 100 for removing and installing light bulbs, normally from elevated locations such as exterior lights and interior lights recessed in high ceilings. The apparatus 100 comprises broadly a pole 105 with a handle 110 on a first end and a gripping unit 115 at a second end. The handle 110 as shown includes finger indentations 120 to accommodate a user's hand comfortably. The handle 110 may also include striations 125 or similar tactile elements to improve a user's grip thereof.

Figure 2:
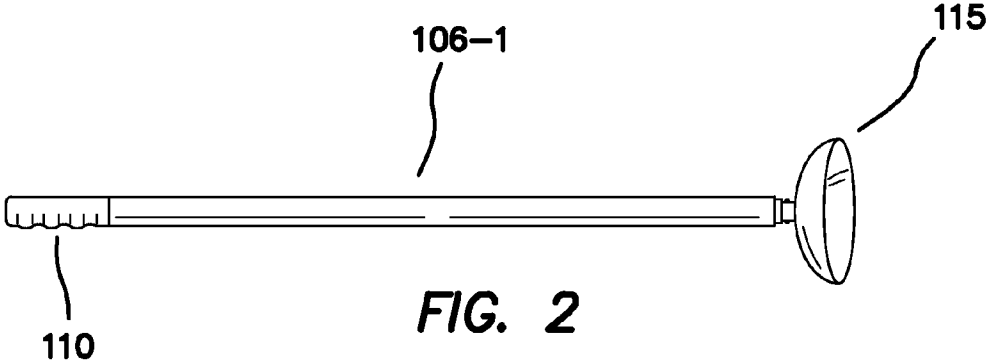
FIG. 2 illustrates a perspective view of the apparatus of FIG. 1 in a stowed position according to the embodiments of the present invention.

A first end of the pole 105 inserts into the handle 110. As shown, the pole 105 is of a telescoping type including three, tapered pole sections 106-1 through 106-3 which fit together in a frictional relationship. Other than a frictional telescoping mechanism, other telescoping systems include turn and release and spring loaded systems or other any other suitable telescoping systems. The pole 105 may be comprised of more or less than three sections. As shown in FIG. 2, pole section 106-3 inserts into pole section 106-2 and both pole sections 106-3 and 106-2 insert into pole section 106-1. A small clip or extension 130 may be integrated in said pole section 106-3 to allow a user to extend the pole sections 106-1 through 106-3 from the stowed position shown in FIG. 2 to a fully extended position (as shown in FIG. 1) or points between. The user may also be able to use the gripping unit 115 to extend the pole 105. Moving from an extended position to the stowed positioned may be accomplished by using the clip 130 or simply pushing on the gripping unit 115 in the direction of the handle 110.

Figure 3A:
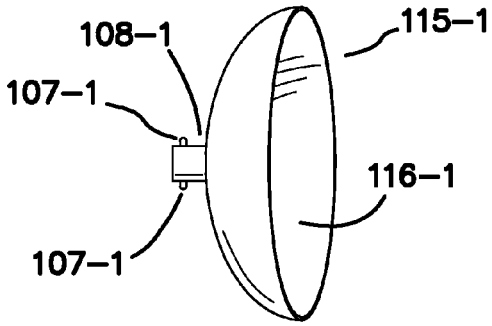
FIGS. 3*a*-3*d* illustrate a perspective view of various gripping units according to the embodiments of the present invention.
Figure 3B:
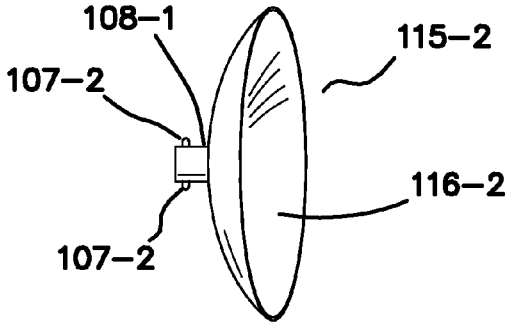
Figure 3C:
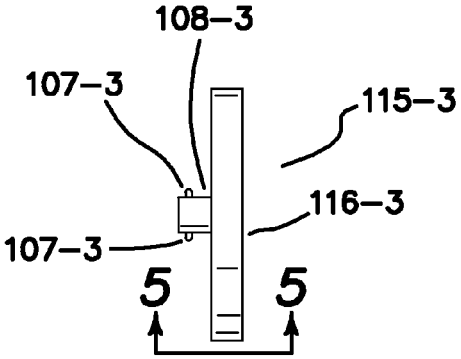
Figure 3D:
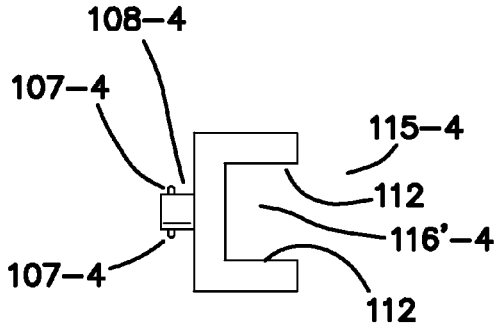
Figure 4A:
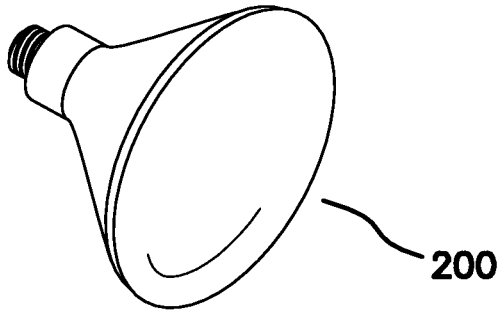
FIG. 4A (Prior Art)
FIGS. 4*a*-4*c* illustrate various light bulbs of the type which may be removed and installed using the apparatus according to the embodiments of the present invention.
Figure 4B:
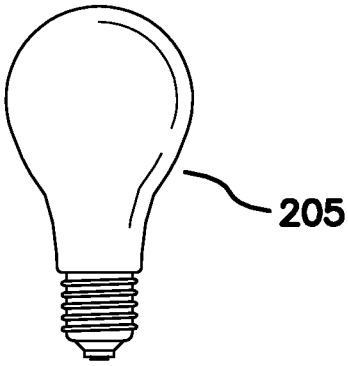
FIG. 4B (Prior Art)
Figure 4C:
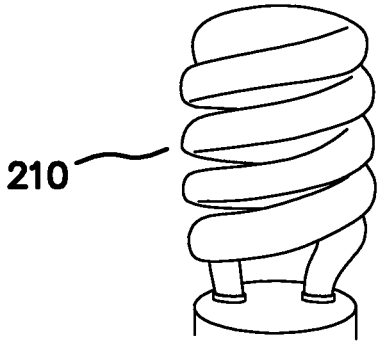
FIG. 4C (Prior Art)

A second end of the pole supports one or more removable gripping units 115. In one embodiment, as shown in FIG. 3*a*, the gripping unit 115-1 is formed as a parabola having a concave surface 116-1 configured to contact a flood light bulb 200 (shown in FIG. 4*a*). FIG. 3*b* shows, in another embodiment, an gripping unit 115-2 formed as a parabola having a concave surface 116-2 (flatter and smaller than gripping unit 115-1) configured to contact an incandescent light bulb 205 (shown in FIG. 4*b*). FIG. 3*c* shows, in another embodiment, an gripping unit 115-3 formed with a flat member surface 116-3 to contact a top surface of a fluorescent light bulb 210 (shown in FIG. 4*c*). In another embodiment, shown in FIG. 3*d*, an gripping unit 115-4 includes flat member surface 116-4 and side walls 112 configured to grab sides of the fluorescent light bulb 210. The greater the surface area contact between the gripping unit 115 and light bulb the greater the ability for a user to create torque to remove and install said light bulb. Attaching and removing said gripping units 115 is facilitated by any number of means including two or more spring-biased pins 107-1 through 107-4 integrated within extensions 108-1 through 108-4 and positioned to insert into two or more corresponding openings in said pole 105, namely section 106-3.

In one embodiment, the gripping units 115-1 through 115-4 include an adhesive member formed as a series of grouped sheets 117-1 through 117-N having at least one contact surface coated, integrated or incorporated with an adhesive. The series of grouped sheets 117-1 through 117-N attach to said surfaces 116-1 through 116-4. The adhesive sheets 117-1 through 117-N provides means for allowing a user to control the light bulb by placing the surfaces 116-1 through 116-4 of the gripping units 115-1 through 115-4 in contact with the light bulb thereby connecting the apparatus 100 to the light bulb. By turning the apparatus 100 via the handle 110, the user is able to remove or install an elevated light bulb. Once an adhesive layer on an exposed sheet 117-1 through 117-N is worn away, the sheet 117-1 through 117-N may be removed to reveal a new sheet 117-1 through 117-N. Once all sheets 117-1 through 117-N have been exhausted, a new series of grouped sheets may be may be joined thereto. The series of grouped sheets 117-1 through 117-N may attach to the gripping units 115 using hook and loop fasteners, adhesives, clips, screws or similar fasteners permitting the removal and connection of the grouped sheets 117-1 through 117-N.

Figure 5:
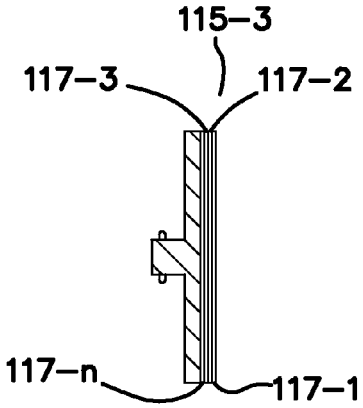
FIG. 5 illustrates cross sections of various adhesive members according to the embodiments of the present invention.
Figure 6A:
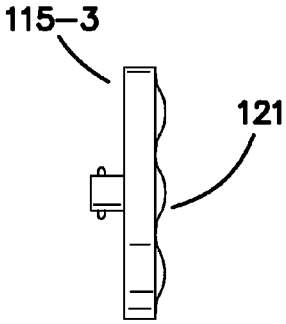
FIGS. 6*a*-6*b* illustrate gripping units comprising rippled and balled forms incorporating or coated with adhesives according to the embodiments of the present invention.
Figure 6B:
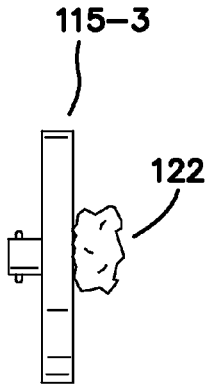

FIG. 5 shows a cross-sectional view of gripping unit 115-3 having layered adhesive sheets 117-1 through 117-N as described above. It is also contemplated that the gripping unit 115 may hold a single adhesive sheet which when exhausted is replaced with a new adhesive sheet. As used throughout this document, the term sheet includes flat, wrinkled, rippled and balled forms of material integrated, coated, incorporated or covered with an adhesive. FIGS. **6*a*-6*b* show exemplary one time adhesive members in the form of usage sheets in rippled 121 and balled forms 122 on gripping unit 115-3, respectively. In one embodiment, the adhesive sheets 117-1 through 117**-N are fabricated of heat resistant materials to prevent damage in the event a user seeks to remove a "hot" light bulb (e.g., incandescent bulb).

While a telescoping or extendible pole is detailed throughout this detailed description, in an alternative embodiment, a non-telescoping pole of any length may be used. Alternatively, the handle may attach directly to the gripping unit. In one embodiment, a short pole or no pole and a handle facilitates the removal of light bulbs, for example, by a user on a lift seeking to remove numerous commercial light bulbs.

Pressure sensitive adhesive applied to film, cloth, metal, plastic or similar substrate materials produce suitable sheets for facilitating the embodiments of the present invention. In another embodiment, heat activated adhesives may be applied to film, cloth, metal, plastic or similar substrate materials produce suitable sheets for facilitating the removal of "hot" bulbs. Applicant has found that hot melt rubber resin used on packing tape manufactured and sold by 3M® is a suitable adhesive. Those skilled in the art will recognize that other adhesives are suitable for the embodiments of the present invention.

Although the invention has been described in detail with reference to several embodiments, additional variations and modifications exist within the scope and spirit of the invention as described and defined in the following claims.

I claim:

1. An apparatus comprising:

an extendible pole;

a handle at a first end of said extendible pole; and a gripping unit at a second end of said pole, said gripping unit (i) configured to contact a light bulb type for removal or installation and (ii) including an adhesive member having multiple disposable sheets with at least one surface of each of said multiple disposable sheets at least partially coated with a tacky substance.

2. The apparatus of claim 1 wherein said gripping unit includes a concave surface configured to contact a flood light bulb.

3. The apparatus of claim 1 wherein said gripping unit includes a concave surface configured to contact an incandescent light bulb.

4. The apparatus of claim 1 wherein said gripping unit includes a flat portion.

5. The apparatus of claim 1 wherein said multiple disposable sheets are in a rippled form.

6. The apparatus of claim 1 wherein said multiple disposable sheets are in a ball form.

7. An apparatus comprising:

a telescoping pole having a handle at a first end thereof;

two or more interchangeable gripping units including an adhesive member having multiple disposable sheets with at least one surface of each of said multiple disposable sheets at least partially coated with a tacky substance; and wherein a second end of said telescoping pole is configured to removably receive said two or more gripping units wherein each of said two or more gripping units is configured to remove and install different light bulb types.

8. The apparatus of claim 7 wherein said two or more gripping units are configured to remove two or more of the following:

(i) flood light bulbs;

(ii) incandescent light bulb; and (iii) compact fluorescent light bulbs.

9. The apparatus of claim 7 wherein one of said two or more gripping units includes a concave surface configured to contact flood light bulb.

10. The apparatus of claim 7 wherein one of said two or more gripping units includes a concave surface configured to contact an incandescent light bulb.

11. The apparatus of claim 7 wherein one of said two or more gripping units includes a flat portion.

12. The apparatus of claim 7 wherein said multiple sheets are in a rippled form.

13. The apparatus of claim 8 wherein said multiple sheets are in a ball form.

14. An apparatus comprising:

a handle;

two or more interchangeable gripping units including an adhesive member having multiple disposable sheets with at least one surface of each of said multiple disposable sheets at least partially coated with a tacky substance; and wherein a second end of said telescoping pole is configured to removably receive said two or more gripping units wherein each of said two or more gripping units is configured to remove and install different light bulb types.

15. The apparatus of claim 14 further comprising a pole between said handle and one of said two or more gripping units.

* * * * *

UNITED STATES PATENT AND TRADEMARK OFFICE

CERTIFICATE OF CORRECTION

PATENT NO. : 8,555,749 B2
APPLICATION NO. : 13/398728
DATED : October 15, 2013
INVENTOR(S) : Frank P. Gatski It is certified that error appears in the above-identified patent and that said Letters Patent is hereby corrected as shown below:

In the Claims:

Column 4, line 42, Claim 13, line 1, delete “claim 8” add -- claim 7 --.

Signed and Sealed this
Thirty-first Day of December, 2013

Margaret A. Focarino

Margaret A. Focarino
*Commissioner for Patents of the United States Patent and Trademark Office*